United States Patent [19]

Walker

[11] 3,972,312

[45] Aug. 3, 1976

[54] EXHAUST GAS RECIRCULATION CONTROL BY HIGH PORT ACTUATED DIAPHRAGM

[76] Inventor: Brooks Walker, 1280 Columbus Ave., San Francisco, Calif. 94133

[22] Filed: Aug. 8, 1975

[21] Appl. No.: 603,037

Related U.S. Application Data

[63] Continuation of Ser. No. 438,699, Feb. 1, 1974, abandoned.

[52] U.S. Cl. ..... 123/119 A; 251/122

[51] Int. Cl.[2] ..... F02M 25/06

[58] Field of Search ..... 123/119 A; 251/122

[56] References Cited

UNITED STATES PATENTS

| | | | |
|---|---|---|---|
| 2,237,554 | 4/1941 | Grove | 251/122 |
| 3,365,883 | 1/1968 | Albelani et al. | 251/122 |
| 3,458,170 | 7/1969 | Vogeli | 251/122 |
| 3,646,923 | 3/1972 | Sarto | 123/119 A |
| 3,717,131 | 2/1973 | Chana et al. | 123/119 A |
| 3,730,156 | 5/1973 | Sarto | 123/119 A |
| 3,828,746 | 8/1974 | DeMartelaere | 123/119 A |
| 3,878,823 | 4/1975 | Vartanian | 123/119 A |
| R27,993 | 4/1974 | Walker | 123/119 A |

*Primary Examiner*—Wendell E. Burns
*Assistant Examiner*—David D. Reynolds
*Attorney, Agent, or Firm*—Owen, Wickersham & Erickson

[57] ABSTRACT

An exhaust gas recirculation system for an internal combustion engine includes a valve in an exhaust gas recycle conduit which is positioned in response to suction at the high port of the carburetor.

8 Claims, 5 Drawing Figures

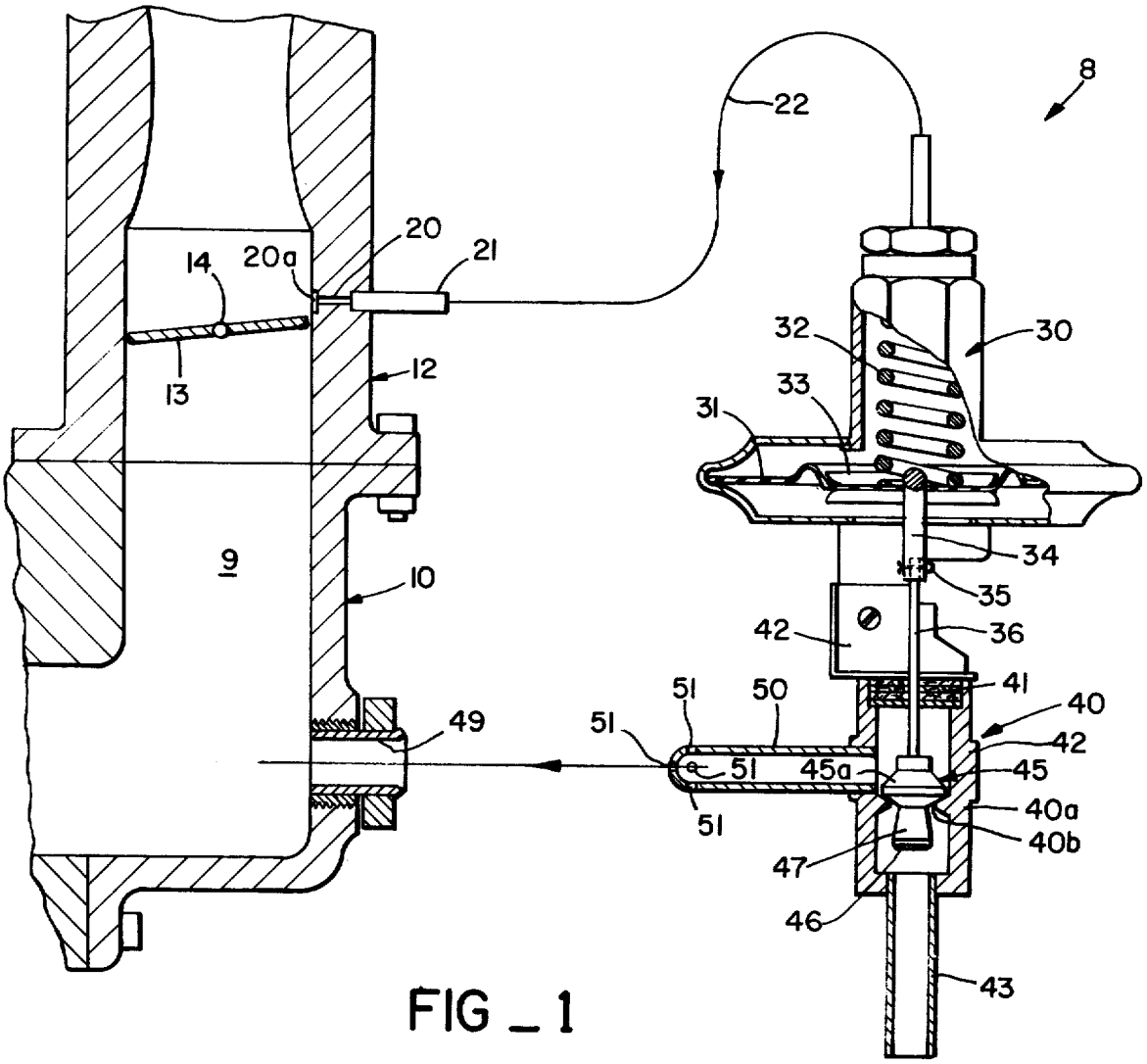
FIG _ 1
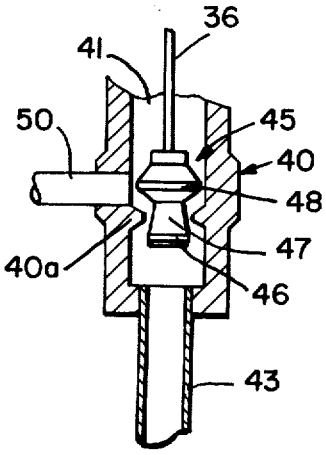
FIG _ 2
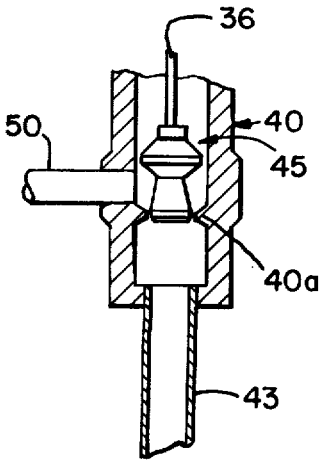
FIG _ 3
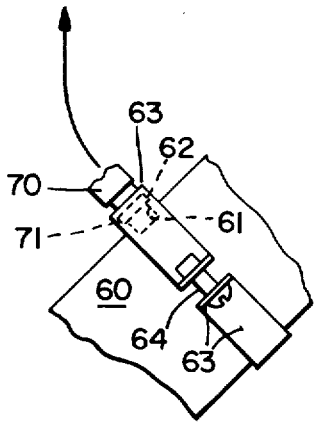

EXHAUST GAS RECIRCULATION CONTROL BY HIGH PORT ACTUATED DIAPHRAGM

This is a continuation, of application Ser. No. 438,699 filed Feb. 1, 1974 now abandoned.

BACKGROUND OF THE INVENTION

This invention relates to an exhaust gas recirculation system for an internal combustion engine. It relates particularly to a recirculation system which recycles exhaust gases into the induction system for the primary purpose of reducing the oxides of nitrogen emitted from the exhaust.

The amount of nitrogen oxides emitted from an internal combustion engine is a function of combustion temperature. Relatively high combustion temperatures, such as occur during engine operation at partially open throttle at level cruise and at relatively high speeds, produce large amounts of nitrogen oxide emissions.

Such emissions are not critical during idling because the rate of fuel combustion is low enough that the combustion temperatures are relatively low.

The engine combustion temperatures normally increase with engine load and with the rate of acceleration at any speed.

However, engine operation at wide open throttle normally results in enough fuel enrichment by the power valve that the combustion temperatures are lowered enough to produce only acceptable amounts of nitrogen oxide emissions. Recycled exhaust gas flows may therefore be discontinued or reduced to a minimum during operation at wide open throttle with the power valve on.

Recycling 5 to 25 percent of the total exhaust gases through the engine (depending on load and power demand) will usually reduce combustion temperatures to levels that do not produce unacceptable amounts of nitrogen oxide emissions. For example, recycling about fifteen percent of the total exhaust gases during partially open throttle will usually produce the desired result.

SUMMARY OF THE INVENTION

It is a general object of the present invention to control the flow of exhaust gas recirculation (through an exhaust gas recycle conduit of the kind described) in a way that produces the desired reduction of nitrogen oxide emissions.

It is a primary object of the present invention to control the exhaust gas recirculation during engine operation in response to suction at the high port of the carburetor. The high port is the port on the upstream side of the leading edge of the carburetor throttle.

The present invention incorporates valve means in the recycle conduit for regulating the flow of recycled exhaust gas through the recycle conduit and control means responsive to the suction at the high port positioning the recycle valve means.

The valve means include a fixed annular valve seat and a movable, elongated valve element. The movable valve element has a radially extending flange near one end and the flange is engageable with the valve seat to block all flow through the recycle conduit. The other end of the valve element is an enlarged part which, when positioned in line with the fixed valve seat reduces the flow passageway through the valve to a minimum. A tapered section extends between the flange and the enlarged end, and this tapered section varies the size of the flow passageway through the valve in direct relation to the movement of the valve element within the valve seat.

The control means include a suction motor having a diaphragm exposed to the suction at the high port on one side and exposed to atmospheric air on the other side. A spring in the suction chamber of the motor biases the diaphragm, and an actuating stem between the diaphragm and the valve element flange with the valve seat.

With this construction, at low high port suctions occurring at engine idle and wide open throttle, the spring biases the diaphragm and actuator stem to engage the flange with the valve seat and to close off flow of recycled gas through the recycle conduit.

As the suction at the high port increases with opening of the butterfly and increasing engine speed, the diaphragm of the suction motor is moved against the biasing spring to move the valve element flange out of engagement with the valve seat and to permit flow of recycled exhaust gases to be recycled. Because the smallest diameter of the tapered portion of the valve element is immediately adjacent the flange, the contoured valve element provides the largest openings at the lower engine intake suctions (where the pressure differential across the recycle valve is the smallest) and provides the more restricted openings at the higher intake suctions (where the pressure differential across the recycle valve is the greatest).

This combination of tapered valve configuration and valve travel in response to suction at the high port provides a substantially uniform percentage of eshaust gas recycle flow in relation to total engine intake flow over most of the engine operating range. The shape of the taper can be tailored to each engine to get the best ratio of exhaust gas recirculation to intake flow for the desired emission reduction.

Exhaust gas recirculation system apparatus and methods which incorporate the structure and techniques described above and which are effective to function as described above constitute specific objects of this invention.

Other objects, advantages and features of my invention will become apparent from the following detailed description of one preferred embodiment taken with the accompanying drawings.

SUMMARY OF PRIOR ART

My U.S. Pat. No. 3,507,260, issued Apr. 21, 1970 and entitled "Exhaust Recirculation Control for an Engine," shows in FIGS. 2 and 3 and exhaust recycle valve having a contour somewhat similar to that of the present invention. This patent, however, does not disclose control means responsive to the suction at the high port for positioning the contoured valve elements shown in FIGS. 2 and 3.

U.S. Pat. No. 3,444,846 issued May 20, 1969 to Sarto et al. and entitled "Engine Exhaust Recirculation" shows a high port operated diaphragm, but the diaphragm operates a butterfly. This patent also does not show a means whereby there is a larger orifice for recirculation at suctions around 8 inches to 9 inches mercury of suction in the intake below atmosphere which is a higher suction than when the power valve is open, i.e. 0 inches to 7 inches mercury below atmosphere, as compared with higher cruise suctions of 15 inches to 18 inches mercury below atmosphere when the differential pressures across the recycle valve are much higher.

In the Sarto et al. patent the control butterflies are wide open at 16 inches mercury at cruise, while the system of the present invention provides a much smaller orifice at 16 inches to 18 inches mercury than at 8 inches mercury below atmoshere. The Sarto et al. patent therefore does not show the combination of valve contour with intake suction variation to produce the substantially uniform percentage of exhaust gas recycle flow in relation to total intake flow over most of the engine operating range of the present invention.

U.S. Pat. No. 3,237,615 issued Mar. 1, 1966 to Daigh and entitled "Exhaust Recycle System" shows, in FIG. 3, a small pintle valve 22*a* that is closed by a spring. The exhaust back pressure and the intake act on the valve to open it. The Daigh valve will close at wide open but it will not close at idle, and greater suction and greater back pressure causes the valve to open wider. The FIG. 3 Daigh valve does not provide a larger orifice at lower suctions around 5 inches to 6 inches mercury than it does at 15 inches mercury.

The other figures of the Daigh patent shows a chain drive between a throttle and the butterfly that controls the exhaust recirculation. The exhaust recirculation valve moves 180° when the throttle moves 90° so that the recirculation valve is closed at wide open throttle and closed at idle and open in between. However, it is not actuated by variations in intake suction. The valve is instead actuated by the position of the butterfly in the carburetor, and it is well known that for a given position of the butterfly in the carburetor at different engine speeds vastly different intake suctions are produced. The Daigh patent construction therefore cannot produce a substantially uniform percentage of exhaust gas recycle flow in relation to intake flow to the engine as accomplished in applicant's construction.

U.S. Pat. No. 1,051,690 issued Jan. 28, 1913 to Colwell and entitled "Internal Combustion Engine" shows a poppet type bypass valve 20 and a second retarding valve 16 above the valve 20, both of which seat. The Colwell construction is not designed for exhaust recirculation for reduction of nitrous oxide, and the construction is not designed to close off or to greatly restrict the recirculation of exhaust gas flow at idle. If the springs were adjusted to close the valve at idle, the upper valve 16 would stay closed during practically all of the driving cycle. If the wide open operation were adjusted so that the poppet valve 20 would open, say at 5 inches mercury of intake suction below atmosphere, then the spring would be such that the valve 16 would never close. The Colwell construction is not operated by a diaphragm or a high port as in the present invention.

U.S. Pat. No. 3,717,130 issued Feb. 20, 1973 to Thornburgh and entitled "Intake Manifold for Exhaust Gas Recirculation and Method of Manufacture" shows a high port operated diaphragm and a plunger for regulating recycled exhaust gas flow through an opening in a common wall between the intake and the exhaust. However, the Thornburgh construction does not provide a larger opening at lower suction when the differential across the recycle valve is lower. Instead, the configuration of the Thornburgh valve is such that the smallest openings are provided at the lowest intake suctions and lowest pressure differentials across the recycle valve. The Thornburgh patent construction therefore cannot keep the percentage of recycled gas flow to total flow as constant as is desirable and as is accomplished by the present invention.

BRIEF DESCRIPTION OF THE DRAWINGS

FIG. 1 is a side elevation view, partly broken away and in cross-section, of an exhaust gas recirculation system constructed in accordance with one embodiment of the present invention. The exhaust gas recirculation valve is shown in FIG. 1 at a closed position of the valve during engine idle or wide open throttle;

FIG. 2 is a fragmentary view like FIG. 1 but showing the exhaust gas recycle control valve in a position of intake suction further below atmospheric and partly open throttle suction such as 8 inches Mg below atmospheric pressure;

FIG. 3 is a view like FIG. 2 showing the valve in a position of intake suction such as level stable cruise at 50–70 mph at 16 inches to 18 inches Hg below atmospheric suction with restricted exhaust gas recirculation but not as restricted as at the throttle idle position shown in FIG. 1;

FIG. 4 shows a construction in which the intake conduit and the exhaust conduit have a close proximity, and the valve to control circulation between the conduits is the means of connecting the conduits.

DESCRIPTION OF THE PREFERRED EMBODIMENTS

Figure 4:
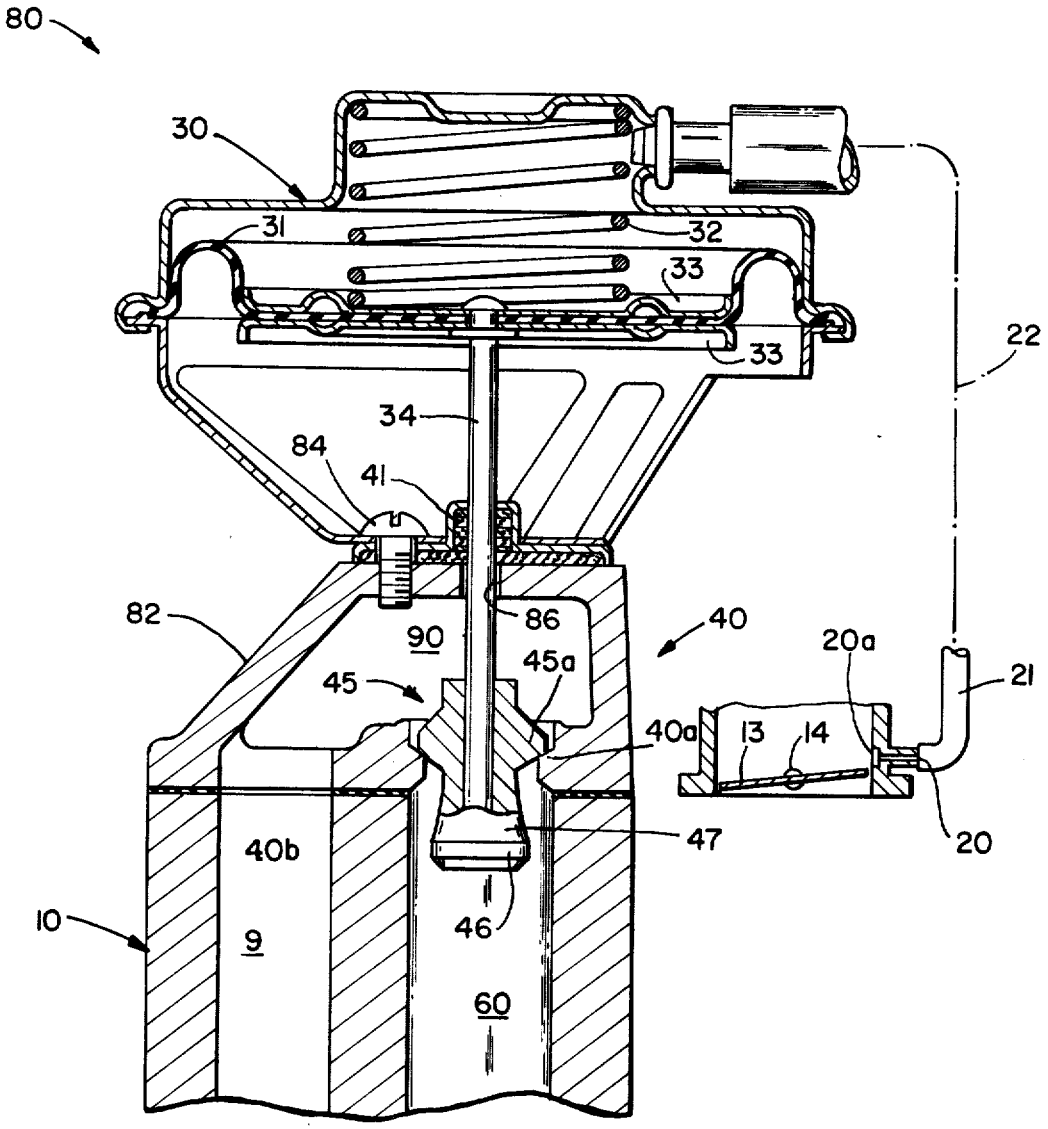
FIG. 4 is a side elevation view in cross section of an exhaust gas recirculation system constructed in accordance with another embodiment of the present invention.

In the figures of the drawings like numerals of reference refer to corresponding parts.

An exhaust gas recirculation system constructed in accordance with one embodiment of the present invention is indicated generally by the reference numeral 8 in FIG. 1.

In FIG. 1 I have shown an engine 10, a carburetor 12 with a throttle butterfly mounted on a shaft 14 with a suitable control (as by a usual foot throttle as shown but common in engine control).

A conduit 22 is shown diagrammatically and connects the upper chamber of a diaphragm actuated valve motor 30 to the high port 20 above the upstream upper edge of the butterfly 13 by tubing 21. The high port 20 may have an elongated slot or rounded opening 20*a* extending along the direction of movement of the adjacent edge of the butterfly 13.

The exhaust gas recirculation system 8 includes an exhaust gas recycle conduit having a tube 43 and a tube 50 for recycling a part of the exhaust gases from the engine exhaust pipe 60 back to the inlet manifold 9.

The system also includes valve means (indicated generally by the reference numeral 40) in the recycle conduit for controlling the flow of recycled gases through the recycle conduit and control means (including the motor 30) responsive to the suction at the high port 20 for positioning the valve means 40.

The motor 30 and valve means 40 may, as illustrated in FIG. 1, be mounted on the engine by a common mounting bracket 42.

The valve means 40 include an outer housing 44 having a radially inwardly projecting flange 40*a* which provides a fixed valve seat.

The valve means 40 include a movable valve element 45.

As illustrated in FIGS. 1, 2 and 3 the valve element 45 is an axially elongated member having a radially extending flange 45*a* at one end, a large diameter part 46 at the other end of the body and a tapered section 47 between the flange 45*a* and the large diameter part 46.

The top surface (as viewed in FIG. 1) of the valve seat 40*a* may preferably have a concavely shaped surface forming a seating surface for engagement with a complementary convexly shaped lower surface on the flange 45*a* of the valve element.

The valve seat 40*a* has an inner axially extending bore 40*b*, and the large diameter lower end 46 is just slightly smaller in diameter than the bore 40*b* so as to provide a minimum flow passageway for recycled gas in the FIG. 3 position of the movable valve element.

The mid section 47 of the valve element has a tapered configuration with the smallest diameter part immediately adjacent the lower side of the flange 45*a*. This provides the largest passage for flow at high port suctions just below atmosphere (as will be described in greater detail below).

The tube 50 of the recycle conduit may be a single fixed tube as illustrated having a length great enough to extend through a fitting 49 mounted in the sidewall of the inlet manifold 9. The end of the tube 50 has a plurality of openings 51 for permitting substantially free and unrestricted flow of recycled gas from the tube 50 into the inlet manifold 9.

The diaphragm 31 and its attached washers are suitably attached to the shaft 34 which may be flexibly attached to a slender shaft 36 by pin 35. The end of the shaft 36 may be hinged or flattened and pierced to receive the pin 35. Such a flexible joint may not be needed due to the flexibility of the diaphragm 31 and the shaft 36 below the seal element 41.

The connections of the exhaust of the engine may be accomplished simply by drawing or punching a hole 61 in the exhaust pipe 60 and securing exhaust recirculation tubing 70 to the exhaust pipe by a snap clamp 63 and a suitable tightening screw 64.

The tubing has a ring or a flange 71 formed or attached so that the clamp 63 secures the tubing 70 to the exhaust pipe 60 in an air-tight relation by a suitable heat resistant gasket 62. This construction is particularly suitable for an exhaust gas recirculation control which may be added to use vehicles as a retrofit kit for nitrous oxide and other exhaust emission controls.

The valve motor 30 houses a spring 32 which urges the center of the diaphragm 31 and attached washers 33 to the lower position illustrated in FIG. 1. In this lower position the movable valve element 45 is engaged on the valve seat 40*a* when the suction in the intake manifold 9 and at the high port 20 is at and near wide open throttle and the power valve (not shown) in the carburetor 12 is operating such as at suctions from 5 to 0 inches mercury below atmospheric pressure.

In operation of the FIGS. 1–3 embodiment, when the throttle is at the idle position with the edge of the throttle blade or butterfly 13 on the engine side of the high port 20 as illustrated in FIG. 1, the suction in the line 22 will be only slightly below the atmosphere due to the restriction offered by the air cleaner (not shown) and the flow past the butterfly 13. In this condition the valve 45 will be on the seat 40*a* due to the action of the spring 32 and the limited suction from the port 20 in the upper chamber of the valve motor 30. This condition is shown in FIG. 1.

When the intake suction is far below atmosphere, as when running at 50 to 70 miles per hour on a level with normally advanced spark, the suction will be in the range of 15 to 18 inches mercury below atmosphere, depending on the engine and the make and the engine size, and the valve 45 will be in the position shown in FIG. 3 with a limited orifice for exhaust gas flow. However, a sufficient amount of exhaust gas can flow past the valve for nitrous oxide control due to the high differential pressure across the valve 40.

When operating at wider open throttle than level cruise, such as on acceleration, hillclimbing, etc., with a suction in the range of 8 inches of mercury below atmopshere, the valve element 45 will be in the position shown in FIG. 2. This provides a much larger opening for exhaust gas flow than at level cruise as shown in FIG. 3. Such a larger opening is necessary at 8 inches mercury below atmosphere to keep the percent of exhaust recirculation approximately constant relative to the intake volume of fuel-air mixture flowing through the carburetor at such a condition of operation. With a larger volume of intake flowing to the engine on acceleration at the same speed than at level cruise at the same speed, a lower differential pressure across the valve element 45 exists, and the opening for the exhaust gas pressure needs to be larger at the acceleration suction than at level cruise suctions at the same speeds of travel of the engine. The opening may, for example, be about twice as large under such acceleration suction when the pressure differential is about one-half as large as compared to level cruise suction.

In all conditions of operation the exhaust back pressure below the valve element exerts a force on the valve element tending to move the valve element upward and in the same direction as increasing suction. However this force is relatively small because of the effective area on which the exhaust pressure acts. It does, of course, become greater at higher engine speeds and/or wider open throttle. This exhaust back pressure adds to the intake suction to create an increased differential pressure at increased power to cause greater flow across the valve opening.

An exhaust gas recirculation system constructed in accordance with a second embodiment of the present invention is indicated generally by the reference numeral 80 in FIG. 4. The engine 10 of the FIG. 4 embodiment is one in which the intake passageway 9 is located in close proximity to the exhaust outlet 60 so that the valve means 40 and the control motor 30 can be attached directly to a header 82 as by mounting screws 84. The actuating stem 34 projects through an opening 86 formed in a sidewall of the header 82, the valve seat bore 46 is formed in a wall member extending across one end of the exhaust passageway 60. The movable valve element 48 is retractable upward off of the valve seat 40*a* within the chamber 90 within the header 82. Thus, in the FIG. 4 embodiment the valve means 40, in effect, form the recycle conduit to minimize the length of the conduit and facilitate installation of the system as a retrofit.

The construction and operation of the FIG. 4 embodiment is otherwise the same as that described above in the embodiment shown in FIGS. 1, 2 and 3 and will therefore not be described in greater detail here.

It should be noted that in all constructions the spring 32 on top of the diaphragm is calibrated to shut off the exhaust gas recirculation at the suction at the high port existing at engine idle. This spring is also calibrated to shut off the exhaust gas recirculation at suctions at the high port at wide open throttle either at the time when the power valve is turned on or some time a little after when the power valve is turned on. That is, the spring 32 can be calibrated so that the exhaust gas recirculation valve 40 will close at suctions (which may be just about 6 inches or 7 inches below atmosphere) just below where the power valve comes in. The spring 32 will move up to its full upward stroke or compression at about 16 inches mercury below atmopsheric pressure.

It should also be noted that on closed throttle deceleration the exhaust gas recirculation valve will be closed in all forms of the present invention. This is desirable because exhaust gas recirculation at closed throttle deceleration might cause increased misses in the engine cylinders.

Figure 5:
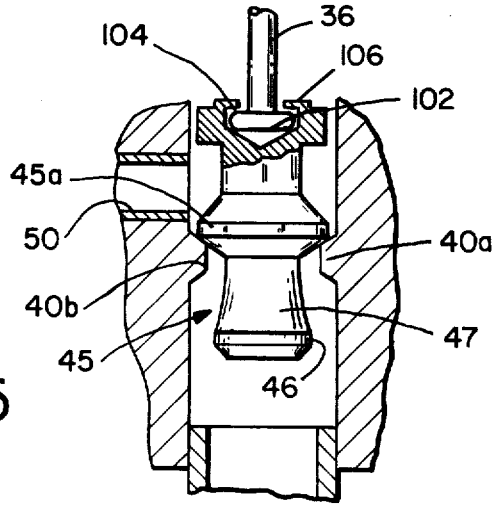
FIG. 5 is an enlarged side elevation view in crosssection showing how the exhaust gas recycle control valves of all embodiments of the present invention can incorporate a flexible or jointed connection to the actuating stem to reduce the tendency to carbon up from the exhaust gases passing the valve and to allow the valve to rattle or wander to a limited extent on the actuating stem to thereby facilitate good seating of the movable valve element on the valve seat.

FIG. 5 shows a flexible connection between the movable valve element and the actuating stem which permits the valve element to rattle or wander to a limited extent in all directions with respect to the valve stem to reduce the tendency to carbon up from exhaust gases passed through the recycle valve.

As illustrated in FIG. 5, the upper surface of the valve element 45 is formed with an opening 102. The lower end of the valve stem 36 has an enlarged end 104 of slightly smaller diameter than the diameter of the opening 102. Flanges or prongs 106 are connected at one end to the upper end of the valve element 45 and are bent over at their free end to engage the flange 104 to prevent movement of that end of the valve stem 36 out of the opening 102. There is enough clearance between the sidewalls of the opening 102, the bottom surface of the opening and the bent-over flanges 106 and the related surfaces of the end 104 to permit the valve stem 36 to shift to a slight extent both sideways and up and down with respect to the valve element 45 so that the valve element 45 seats in good contact with the valve seat 48.

Controlling the valve means 40 in response to the suction at the high port 20 has these advantages.

It permits one position of the movable valve element to substantially restrict or totally block exhaust gas recycle flow at both engine idle and wide open throttle conditions of operation. In either condition of engine operation very little or no exhaust gas recycle flow is desired. At engine idle operation the combustion temperatures are low enough not to produce excessive emissions of nitrous oxide. At wide open throttle operation the power valve in the carburetor, under normal conditions of operation without a power valve delay, enriches the fuel-air ratio mixture sufficiently to lower the combustion chamber temperatures below the level at which excessive amounts of nitrous oxide emissions are formed.

The positioning and response to the suction at the high port permits increased movement of the valve element with increase in the amount of suction below atmosphere. Thus, the valve element can be provided with a simple taper or tailored shape to provide the largest flow passageway at suctions just below atmosphere when the power valve closes around 7 inches mercury below atmosphere on some engines, where the differential pressure is least, and more restricted flow passageways at greater suctions below atmosphere such as high speed level cruises around 60 miles per hour where the pressure differential across the valve is greater. This combination of tapered or tailored valve configuration and valve travel in response to suction at the high port provides a substantially uniform percentage of exhaust gas recycle flow in relation to total intake flow to the engine over most of the engine operating range.

To those skilled in the art to which this invention relates, many changes in construction and widely differing embodiments and applications of the invention will suggest themselves without departing from the spirit and scope of the invention. The disclosures and the description herein are purely illustratively and are not intended to be in any sense limiting.

I claim:

1. An exhaust gas recirculation system for a reciprocating piston internal combustion engine of the kind having a carburetor with a high port adjacent and upstream of the leading edge of a butterfly in the carburetor intake conduit when in the engine idle condition and an exhaust gas recycle conduit for recycling a part of the exhaust gases from the engine exhaust outlet back to the engine induction inlet, said system comprising valve means in the recycle conduit comprising an annular valve seat having a radially extending seating surface and a short axially extending cylindrical bore providing a single opening through which all of the exhaust gas recirculation flow in the recycle conduit must pass to get into the engine induction inlet, said valve means also comprising a movable axially elongated valve element with an axially extending body of smaller diameter than said bore and having at one end a radially extending flange for engaging said seating surface in a seated position of said valve element, said body joining said flange at a narrow neck and continuously and gradually flaring away therefrom toward an opposite end portion of slightly smaller diameter than said single opening, control means responsive to suction at the high port for positioning the valve element, said valve element thereby restricting said opening to flow of exhaust gas through the conduit to a first minimum in a seated first position of the valve element corresponding to suctions at said high port in the range of 0–7 inches mercury below atmosphere existing at both engine idle and at or near wide open throttle at said high port, said opposite end portion restricting flow to a second restricted minimum opening in a second position of the valve element corresponding to engine intake suctions in the range of 15–18 inches mercury existing at level stable cruises at speeds of 50–70 mph with normally advanced spark, said second minimum opening still providing a substantial passage for exhaust gas recirculation flow, the flaring of said body continuously and gradually cooperating with said single opening to gradate the clearance between said body and said single opening at relatively high intake suctions in substantially all positions of the valve element between said first and second positions, said gradated clearance being greatest at suctions approaching 7 inches mercury below atmosphere and gradually and continuously being reduced at the suction approahes the range of 15–18 inches, said movable valve element thereby progressively reducing the size of the clearance for the passage of exhaust gas recirculation flow through the valve means with progressive increase of intake suctions below atmospheric pressure at the high port between 8 inches mercury and 15 inches mercury below atmospheric pressure.

2. The invention defined in claim 1 wherein the generally radially extending surface of the valve seat has a concavely shaped configuration and the engaging surface of the flange has a complementary convexly shaped surface.

3. The invention defined in claim 1 wherein the control means include an actuator stem connected to the valve element and including connection means between the actuator stem and the valve element for permitting the valve element to move to a limited extent in many directions with respect to the valve stem to reduce the tendency to carbon up from exhaust gases passing through the valve means.

4. The invention defined in claim 2 including a spring for biasing the movable wall member in a direction opposite the direction of movement of the wall member produced by increasing suction at the high port.

5. The invention defined in claim 1 wherein the high port includes an enlarged opening at the carburetor throat end extending in the direction of movement of the leading edge of the butterfly.

6. The system of claim 1 wherein said seating surface is frustoconical sloping inwardly as it narrows, said flange also being frustoconical and sloping inwardly toward said neck, said body also being frustoconical and sloping outwardly from said neck to said opposite end portion.

7. An exhaust gas recirculation system for a reciprocating piston internal combustion engine of the kind having a carburetor with a high port adjacent and upstream of the leading edge of a butterfly in the carburetor intake conduit when in the engine idle condition and an exhaust gas recycle conduit for recycling a part of the exhaust gases from the engine exhaust outlet back to the engine induction intake, said system comprising, valve means in the recycle conduit and having a shouldered valve opening and a movable valve element, control means responsive to suction at the high port for positioning the valve element, said valve element having an axially extending body of smaller diameter than said valve opening and having at one end a radially extending flange for engaging the shoulder of said valve opening, said body joining said flange at a narrow neck and continuously and gradually flaring away therefrom toward an opposite end portion of slightly smaller diameter than said angle opening, the contour of said movable valve element being shaped to maintain, in combination with the changing pressure differential existing across the valve means at changing engine operating intermediate conditions between near wide open throttle and level stable cruises at 50–70 mph by controls including suctions at said high port, a nearly uniform percentage of exhaust gas recirculation during said intermediate operations of the engine.

8. An exhaust gas recirculation system for a reciprocating piston internal combustion engine of the kind having a carburetor with a high port adjacent and upstream of the leading edge of a butterfly in the carburetor intake conduit when in the engine idle condition and an exhaust gas recycle conduit for recycling a part of the exhaust gases from the engine exhaust outlet back to the engine induction inlet, said system comprising valve means in the recycle conduit comprising an annular valve seat having a radially extending seating surface and a short axially extending cylindrical bore providing a valve opening through which exhaust gas recirculation flows on the way to the engine induction inlet, said valve means also comprising a movable axially elongated valve element with an axially extending body of smaller diameter than said bore and having at one end a radially extending flange for engaging said seating surface in a seated position of said valve element, said body joining said flange at a narrow neck and continuously and gradually flaring away therefrom toward an opposite end portion of slightly smaller diameter than said valve opening, control means responsive to suction at the high port for positioning said valve element, said valve element thereby restricting said opening to flow of exhaust gas through the conduit to a first minimum in a seated first position of the valve element corresponding to first intake suction values somewhat below atmosphere, existing at both engine idle and at or near wide open throttle at said high port, said opposite end portion providing a second restricted minimum opening in a second position of the valve element corresponding to second engine intake suction values greatly below atmospheric, existing at level stable cruise at speeds of 50–70 mph with normally advanced spark, said second minimum opening still providing a substantial passage for exhaust gas recirculation flow, the flaring of said body continuously and gradually cooperating with said valve opening to gradate the clearance between said body and said single opening at third intake suction values including substantially all positions of the valve element between said first and second positions and all intake suction values between said first and second intake suction values, said gradated opening being greatest at suctions approaching said first suction values and gradually and continuously being reduced as the suction approaches said second suction values.

* * * * *